US007340912B1

(12) United States Patent
Yoho, Sr. et al.

(10) Patent No.: US 7,340,912 B1
(45) Date of Patent: Mar. 11, 2008

(54) HIGH EFFICIENCY HEATING, VENTILATING AND AIR CONDITIONING SYSTEM

(76) Inventors: Robert W. Yoho, Sr., 12345 Starkey Rd., Suite A, Largo, FL (US) 33773; Ronald James Weber, 156 SE. Monroe Cir. N., St. Petersburg, FL (US) 33703

( * ) Notice: Subject to any disclaimer, the term of this patent is extended or adjusted under 35 U.S.C. 154(b) by 317 days.

(21) Appl. No.: 11/245,393

(22) Filed: Oct. 6, 2005

(51) Int. Cl.
*F25B 25/00* (2006.01)

(52) U.S. Cl. ..... 62/305; 62/310; 62/332

(58) Field of Classification Search ..... 62/304, 62/305, 310, 332, 333
See application file for complete search history.

(56) References Cited

U.S. PATENT DOCUMENTS 3,102,399 A * 9/1963 Meckler ..... 62/271
4,107,942 A * 8/1978 Fairman ..... 62/305
4,313,310 A * 2/1982 Kobayashi et al. ..... 62/175
4,334,412 A * 6/1982 Wildfeuer ..... 62/333
4,903,503 A * 2/1990 Meckler ..... 62/238.3
4,932,221 A * 6/1990 Shimizu et al. ..... 62/180

* cited by examiner

*Primary Examiner*—William E. Tapolcai
(74) *Attorney, Agent, or Firm*—Edward P. Dutkiewicz

(57) ABSTRACT

A primary air flow path has a pre-cooler and an evaporator. A secondary air flow path includes portions of an air conditioner assembly including a compressor and an condenser. The air conditioner assembly also has lines connecting the compressor and the condenser the evaporator. A cooling tower has a coolant fluid input and output with a heat exchanger section. The heat exchanger section conveys coolant fluid. A pump causes cooling flow of water over the section. The coolant fluid output is adapted to feed a coolant fluid in two coolant fluid paths. The first fluid path is in heat exchanging relationship with the air conditioner assembly. The second fluid pat is coupled to the pre-cooler.

8 Claims, 6 Drawing Sheets

HIGH EFFICIENCY HEATING, VENTILATING AND AIR CONDITIONING SYSTEM

BACKGROUND OF THE INVENTION

1. Field of the Invention

The present invention relates to a high efficiency heating, ventilating and air conditioning system and more particularly pertains to maximizing the safety and efficiency of air conditioning and dehumidifying units.

2. Description of the Prior Art

The use of air conditioning systems of known designs and configurations is known in the prior art. More specifically, air conditioning systems of known designs and configurations previously devised and utilized for the purpose of conditioning air through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,373,346 issued Feb. 15, 1983 to Hebert relates to a Precool/Subcool System and Condenser Therefor.

While this device fulfills its respective, particular objectives and requirements, the aforementioned patent does not describe a high efficiency heating, ventilating and air conditioning system that allows maximizing the safety and efficiency of air conditioning and dehumidifying units.

In this respect, the high efficiency heating, ventilating and air conditioning system according to the present invention substantially departs from the conventional concepts and designs of the prior art, and in doing so provides an apparatus primarily developed for the purpose of maximizing the safety and efficiency of air conditioning and dehumidifying units.

Therefore, it can be appreciated that there exists a continuing need for a new and improved high efficiency heating, ventilating and air conditioning system which can be used for maximizing the safety and efficiency of air conditioning and dehumidifying units. In this regard, the present invention substantially fulfills this need.

SUMMARY OF THE INVENTION

In view of the foregoing disadvantages inherent in the known types of air conditioning systems of known designs and configurations now present in the prior art, the present invention provides an improved high efficiency heating, ventilating and air conditioning system. As such, the general purpose of the present invention, which will be described subsequently in greater detail, is to provide a new and improved high efficiency heating, ventilating and air conditioning system and method which has all the advantages of the prior art and none of the disadvantages.

To attain this, the present invention essentially comprises a high efficiency heating, ventilating and air conditioning system. First provided is a primary air flow path. The primary air flow path has an input end. The input end receives air to be conditioned. The primary air flow path has an output end. The output end provides cooled air to a space to be cooled. The primary air flow path has an air filter. The air filter is adjacent to the input end. The primary air flow path has a blower. The blower is provided adjacent to the output end. The primary air flow path also includes a pre-cooler. The pre-cooler is provided between the air filter and the blower. An evaporator is provided between the pre-cooler and the blower.

Further provided is a secondary air flow path. The secondary air flow path has an input end. The input end receives air. The secondary air flow path has an output end. The output end expels air. The secondary air flow path also has portions of an air conditioner assembly. The air conditioner assembly includes a compressor. The compressor is provided between the air input end and the fan and with a condenser between the compressor and the fan. The air conditioner assembly also includes a first line. The first line connects the compressor and the condenser. The air conditioner assembly also includes a second line. The second line connects the condenser and the evaporator. The air conditioner assembly further includes a third line. The third line connects the evaporator and the compressor. The lines function to convey a working fluid between the components of the air conditioner assembly.

Provided last is an open loop direct evaporative cooling tower. The tower has a coolant fluid input and a coolant fluid output. The tower has a heat exchanger section. The heat exchanger section conveys coolant fluid between the coolant fluid input and coolant fluid output. The tower is an open loop configuration in this embodiment and includes a reservoir. The reservoir has a pump. The pump causes a cooling flow of coolant fluid from below the heat exchanger section to a location above the heat exchanger section for flowing over the heat exchanger section to cool the coolant fluid. The tower also has a fan there above. The fan further cools the coolant fluid. In an alternate embodiment of the invention, a closed loop cooling tower is utilized.

The fluid output has two pumps. The pumps move a coolant fluid in two coolant fluid paths. The first coolant fluid path is in heat exchanging relationship with the second line of the air conditioner assembly and then the first line of the air conditioner assembly and then back to the coolant fluid input. The second coolant fluid path couples from the coolant fluid output to the pre-cooler and then back to the coolant fluid input.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved high efficiency heating, ventilating and air conditioning system which has all of the advantages of the prior art air conditioning systems of known designs and configurations and none of the disadvantages.

It is another object of the present invention to provide a new and improved high efficiency heating, ventilating and air conditioning system which may be easily and efficiently manufactured and marketed.

It is further object of the present invention to provide a new and improved high efficiency heating, ventilating and air conditioning system which is of durable and reliable constructions.

An even further object of the present invention is to provide a new and improved high efficiency heating, ventilating and air conditioning system which is susceptible of a low cost of manufacture with regard to both materials and labor, and which accordingly is then susceptible of low prices of sale to the consuming public, thereby making such high efficiency heating, ventilating and air conditioning system economically available.

Even still another object of the present invention is to provide a high efficiency heating, ventilating and air conditioning system for maximizing the safety and efficiency of air conditioning and dehumidifying units.

Lastly, it is an object of the present invention to provide a new and improved high efficiency heating, ventilating and air conditioning system. A primary air flow path has a pre-cooler and an evaporator. A secondary air flow path includes portions of an air conditioner assembly. The air conditioner assembly has a compressor and an condenser. The air conditioner assembly also has lines connecting the compressor and the condenser and the evaporator. A cooling tower has a coolant fluid input and output with a heat exchanger section. The heat exchanger section conveys coolant fluid. A pump causes a cooling flow of water over the heat exchanger section. The fluid output is adapted to feed a coolant fluid in two separate coolant fluid paths. The first fluid path is in heat exchanging relationship with the air conditioner assembly. The second fluid path is coupled to the pre-cooler.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
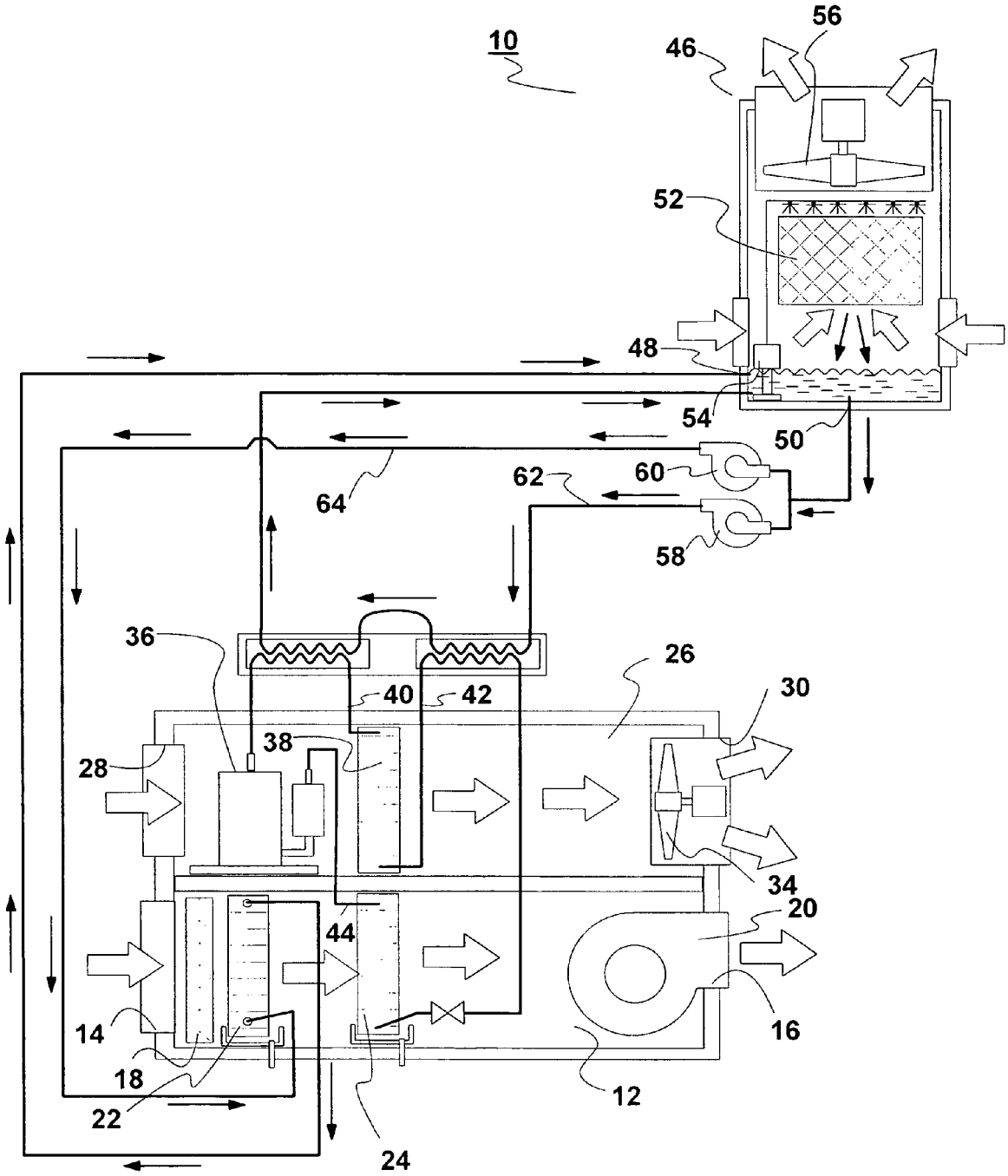
FIG. 1 is a side elevational view of a high efficiency heating, ventilating and air conditioning system constructed in accordance with the principles of the present invention.

With reference now to the drawings, and in particular to FIG. 1 thereof, the preferred embodiment, FIG. 2, of the new and improved HVAC, high efficiency heating, ventilating and air conditioning system embodying the principles and concepts of the present invention and generally designated by the reference numeral 10 will be described.

The present invention, the high efficiency heating, ventilating and air conditioning system 10 is comprised of a plurality of components. Such components in their broadest context include a primary air flow path, a secondary air flow path, and a cooling tower. Such components are individually configured and correlated with respect to each other so as to attain the desired objective.

First provided is a primary air flow path 12. The primary air flow path has an input end 14. The input end receives air to be conditioned. The primary air flow path has an output end 16. The output end provides cooled air to a space to be cooled. The primary air flow path has an air filter 18. The air filter is adjacent to the input end. The primary air flow path has a blower 20. The blower is provided adjacent to the output end. The primary air flow path also includes a pre-cooler 22. The pre-cooler is provided between the air filter and the blower. An evaporator 24 is provided between the pre-cooler and the blower.

Further provided is a secondary air flow path 26. The secondary air flow path has an input end 28. The input end receives air. The secondary air flow path has an output end 30. The output end expels air. The secondary air flow path has a fan 34. The fan is provided adjacent to the output end. The secondary air flow path also has portions of an air conditioner assembly. The air conditioner assembly includes a compressor 36. The compressor is provided between the air input and the fan and with a condenser 38 between the compressor and the fan. The air conditioner assembly also includes a first line 40. The first line connects the compressor and the condenser. The air conditioner assembly also includes a second line 42. The second line connects the condenser and the evaporator. The air conditioner assembly further includes a third line 44. The third line connects the evaporator and the compressor. The lines function to convey a working fluid between the components of the air conditioner assembly.

Provided last is an open loop direct evaporative cooling tower 46. The tower has a coolant fluid input 48 above and a coolant fluid output 50. The tower has a heat exchanger section 52. The heat exchanger section conveys coolant fluid between the coolant fluid input and coolant fluid output. The tower has a reservoir below. The reservoir has a pump 54. The pump causes a cooling flow of water from below the heat exchanger section to a location above the heat exchanger section for flowing over the heat exchanger section for evaporation to cool the coolant fluid. The tower also has a fan 56 there above. The fan further evaporates and cools the coolant fluid. The fluid output has two pumps 58, 60. The pumps pump a coolant fluid in two separate coolant fluid paths 62, 64. The first coolant fluid path is in heat exchanging relationship with the second line of the air conditioner assembly and then the first line of the air conditioner assembly and then back to the coolant fluid input. The second coolant fluid path 64 couples from the coolant fluid output to the pre-cooler and then back to the coolant fluid input.

In the embodiment of FIG. 1, the invention includes a cooling tower which is a direct evaporative cooling tower. The tower is in open loop configuration.

The direct evaporative device or cooling tower in open loop will evaporate and cool the fluid to a temperature close to the web bulb of the air. A fan will pull the moist air from the system and the cooled fluid will be received by the tower container from which it will be pumped into fluid path which goes to the liquid to liquid heat exchangers, attached to the first line as a first heat exchanger and attached to the second line as a second heat exchanger, returning later to the tower container. In this path the fluid heat exchanger will cool the warm gas refrigerant before the expansion device. The heat exchanger will cool the hot gas refrigerant from the compressor before the condenser heat exchanger. These two exchangers will increase the sub-cooling and de-superheating respectively thereby increasing the total efficiency of the air conditioning unit. Each of the heat exchangers may be used independently or without the other if the process requires.

The other fluid path from the cooling tower container will be pumped to a heat exchanger to pre-cool the air before it is cooled below the dew point with the evaporator heat exchanger saving energy to the cooling system.

Condensation may occur in heat exchangers and will be collected in drain pans to be disposed out of the system or be dumped in the cooling tower container.

Figure 2:
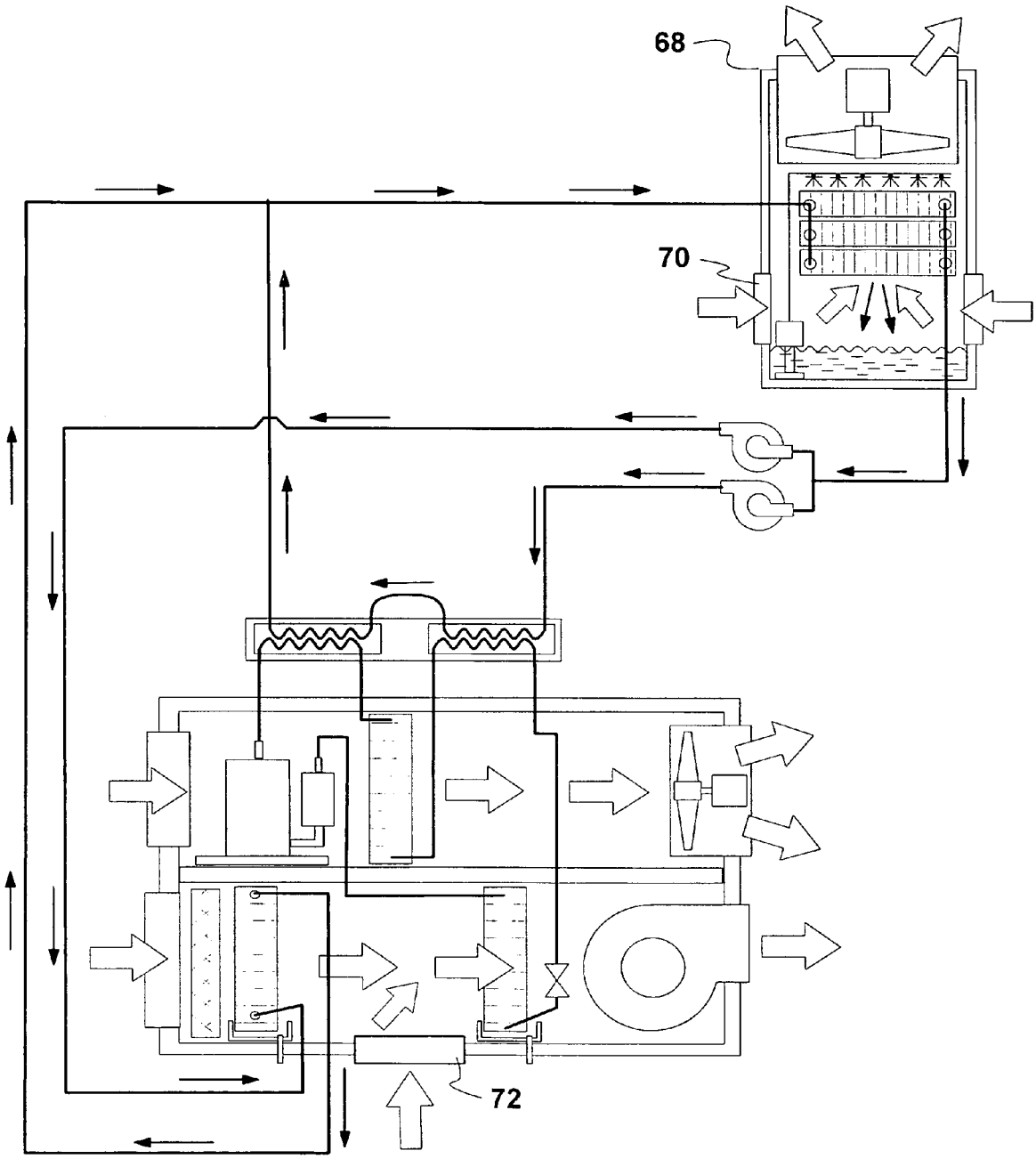
FIG. 2 is side elevational view of a high efficiency heating, ventilating and air conditioning system constructed in accordance with an alternate embodiment of the present invention.

In the embodiment of FIG. 2, the invention includes a cooling tower which is a closed loop cooling tower 68. A cooling fluid is pumped to flow over the heat exchanger section to cool the cooling fluid. The tower has an air intake opening 70. In addition, the primary air path has an opening 72 between the pre-cooler and the evaporator as for recirculating indoor air. In this manner return air may be introduced to the primary air path between the pre-cooler and the evaporator.

This embodiment expands that of FIG. 1 to illustrate the cooling tower in a closed loop configuration where the cooling fluid will exchanger heat with the fluid inside the heat exchangers section. In this section, the working fluid is in a path which is not in direct contact with the cooling tower cooled fluid.

Figure 3:
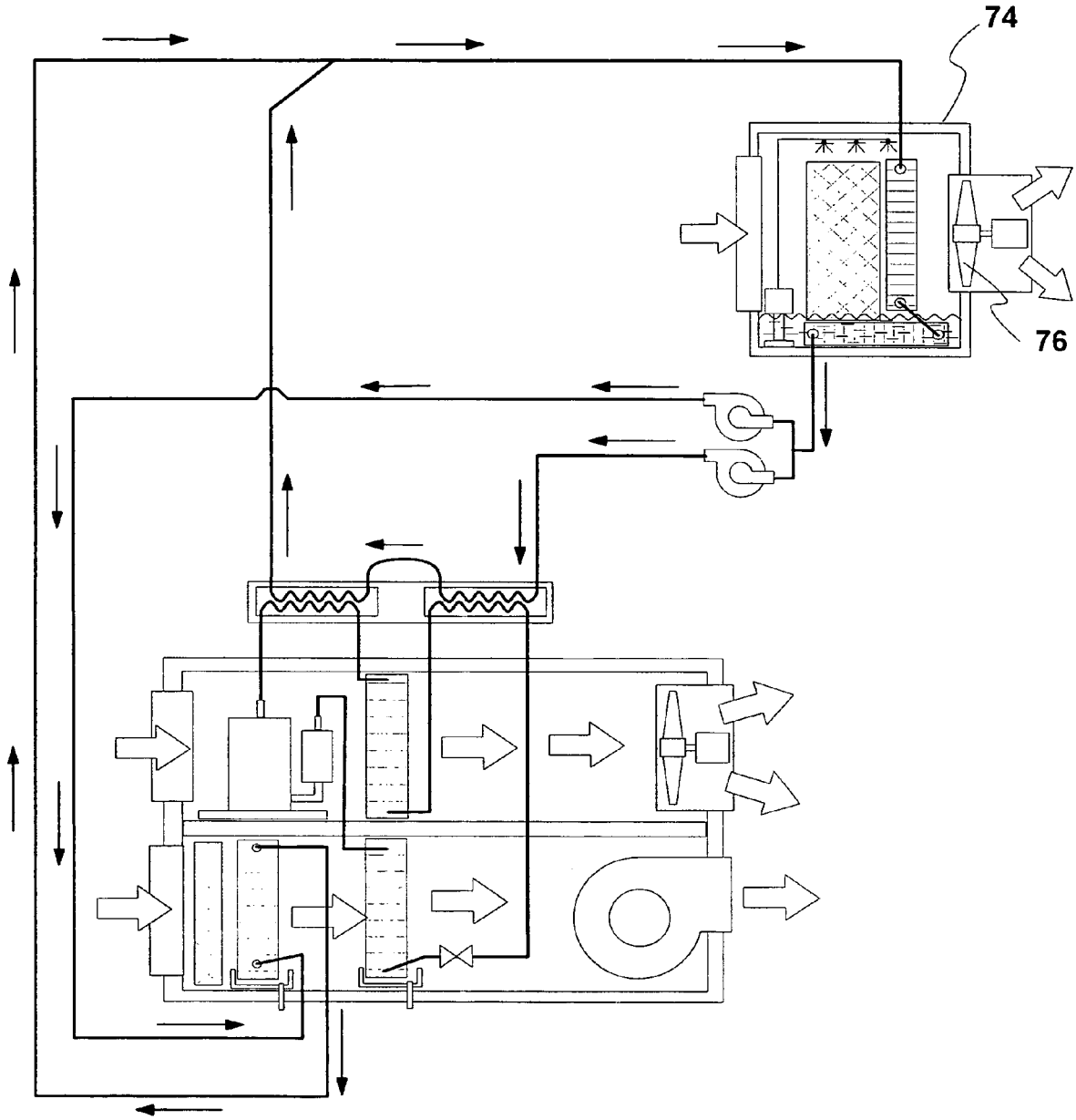
FIGS. 3 through 6 are side elevational views of further systems constructed in accordance with alternate embodiments of the present invention.

In the next alternate embodiment of the present invention, as seen in FIG. 3, the cooling tower is a closed loop cooling tower 74 with a cooling spray. The tower further includes a fan 76. The fan is provided to one side of the tower.

This embodiments expands that of the previous Figure to illustrate the cooling tower in a closed loop configuration fitted with a wet evaporative pad or media that will pre-cool the air and the cold fluid will exchange heat with fluid in the heat exchanger section with part of them immersed in the cooling tower fluid. In this section, the working fluid moves in a path which is not in direct contact with the cooling tower cooled fluid.

Figure 4:
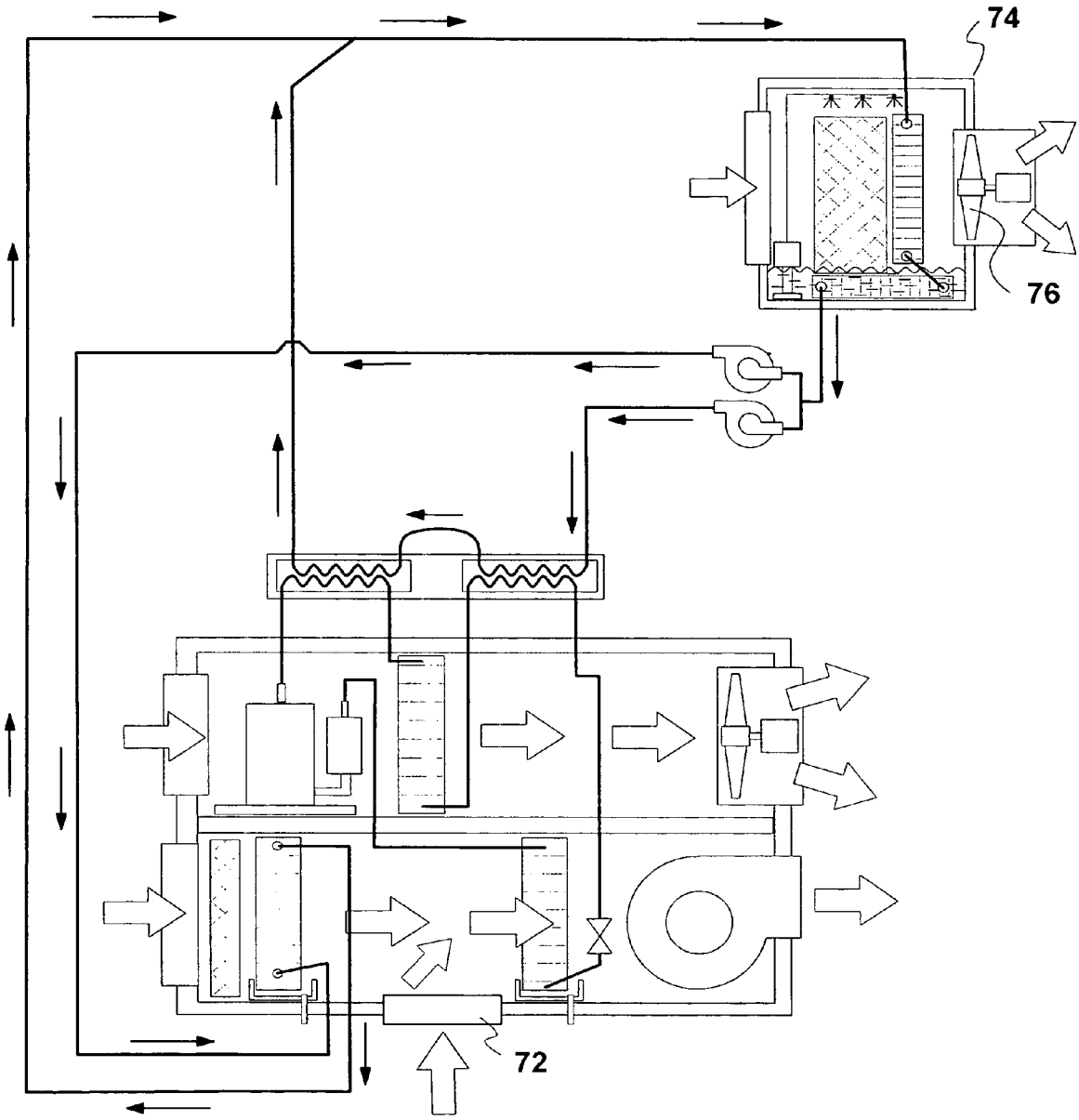

FIG. 4 illustrates another embodiment of the present invention wherein the cooling tower is a closed loop cooling tower 74. The tower further includes a fan 76. The fan is provided to one side of the tower. The primary air path has an opening 72. In this manner return indoor air may be introduced to the primary air path between the pre-cooler and the evaporator.

This embodiment expands the FIG. 3 embodiment to illustrate the outdoor air being pre-cooled by the heat exchanger and then mixing with the re-circulated return air from the indoor space. This air mixture will be directed to the evaporator where it is cooled below the dew point of the indoor space.

Figure 5:
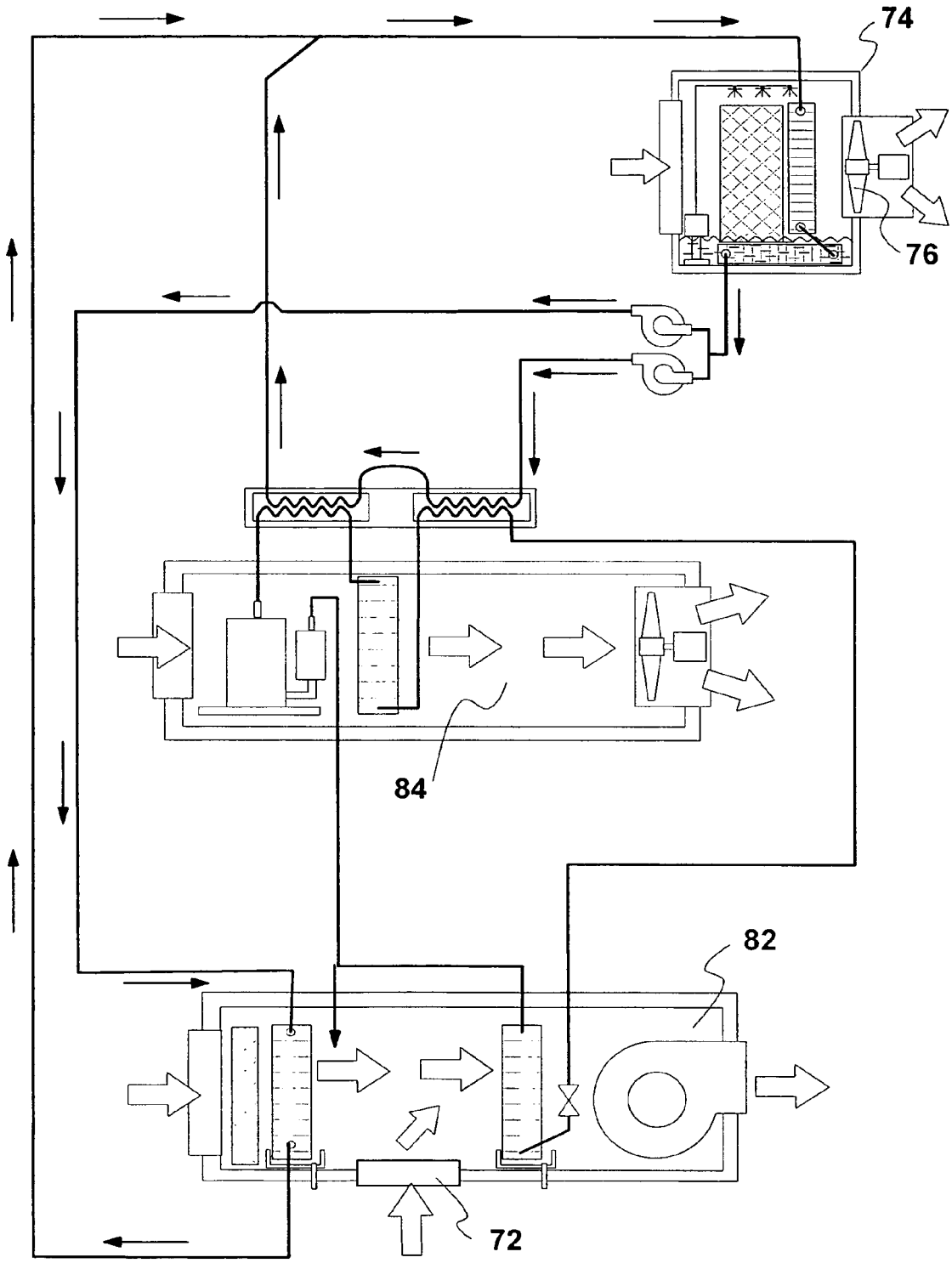

A further alternate embodiment of the present invention is shown in FIG. 5. The cooling tower is a closed loop cooling tower 74. The tower further includes a fan 76. The fan is provided to one side of the tower. The primary air path has an opening 72. In this manner return air may be introduced to the primary air path between the pre-cooler and the evaporator. A primary air path 82 and the secondary air path 84 are provided. The primary and secondary air paths are split with respect to each other.

This embodiment expands the embodiment of FIG. 4 to illustrate the condensing section split or separated form the evaporator section.

Figure 6:
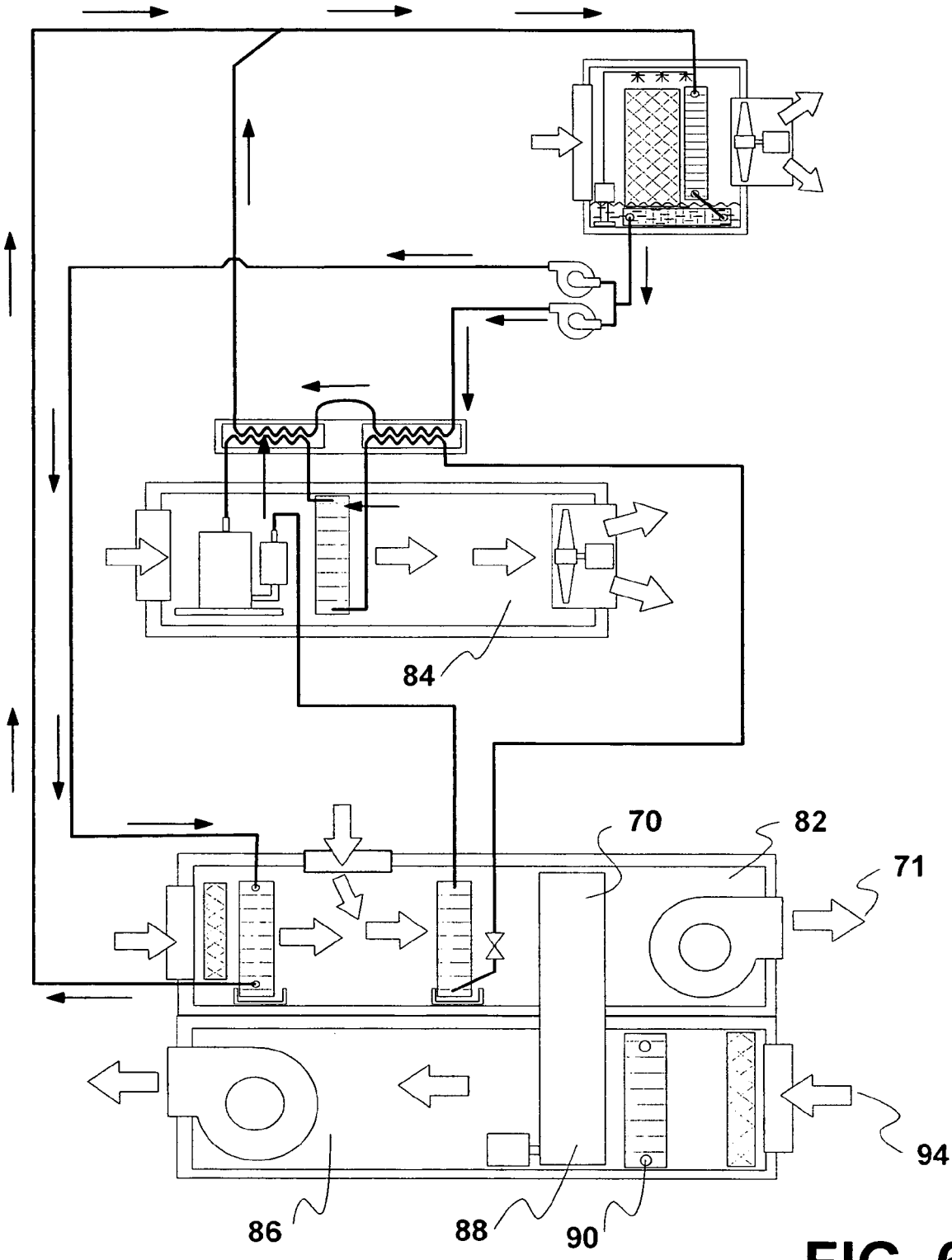

The last alternate embodiment of the present invention is illustrated in FIG. 6. Such embodiment includes a cooling tower which is a closed loop cooling tower. A primary air path 82 and a secondary air path 84 are provided. The primary and secondary air paths are split with respect to each other. The system further includes a tertiary air path 86. The tertiary air path is adjacent to the primary air path. The tertiary air path has a desiccant wheel 88. The wheel is mounted for rotation through the primary air path between the evaporator and the output and through the tertiary air path with a heat exchanger 90 between the desiccant wheel and the air input.

This embodiment expands the embodiment of FIG. 5 to illustrate the closed loop system with the addition of a desiccant dehumidifier package which contains the wheel or rotor to dry the air down the air stream after the evaporator and before supplying the air to the indoor space. The desiccant system requires a regeneration air path using a heat exchanger for heating the air before the wheel or rotor. The outdoor air 94 will intake at the opening and be filtered by and heated with the heat exchanger, drying a section of the wheel and then exhausted to the outdoors with the blower.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An HVAC system comprising:

a primary air flow path having a pre-cooler and an evaporator;

a secondary air flow path including portions of an air conditioner assembly having a compressor and a condenser, the air conditioner assembly also including lines connecting the compressor and the condenser and the evaporator; and a cooling tower with a coolant fluid input and output with a heat exchanger section for conveying coolant fluid and a pump to cause a cooling flow of water over the section, the fluid output adapted to feed a coolant fluid in two coolant fluid paths, a first in heat exchanging relationship with the air conditioner assembly and a second coupled to the pre-cooler.

2. The system as set forth in claim 1 wherein the cooling tower is a direct evaporative cooling tower in open loop configuration and further including a fan above the tower and an air opening in a side of the tower.

3. The system as set forth in claim 1 wherein the cooling tower is a closed loop cooling tower and further including a fan above the tower and an opening for introducing return air to the primary air flow path between the pre-cooler and the evaporator.

4. The system as set forth in claim 1 wherein the cooling tower is a closed loop cooling tower and further including a fan to one side of the tower.

5. The system as set forth in claim 4 and further including an opening for introducing return air to the primary air flow path between the pre-cooler and the evaporator, the cooling tower having a reservoir and a heat exchanger with a portion of the heat exchanger located in the reservoir.

6. The system as set forth in claim 1 wherein the primary air flow path and the secondary air flow path are split with respect to each other.

7. The system as set forth in claim 6 and further including a tertiary air flow path adjacent to the primary air flow path with a desiccant wheel mounted for rotation through the primary air flow path between the evaporator and the output and through the tertiary air flow path.

8. A high efficiency heating, ventilating and air conditioning system for maximizing the safety and efficiency of air conditioning and dehumidifying units comprising, in combination:

a primary air flow path having an input end for receiving air to be conditioned and an output end for providing cooled air to a space to be cooled, the primary air flow path having an air filter adjacent to the input end and a blower adjacent to the output end, the primary air flow path also including a pre-cooler between the air filter and the blower with an evaporator between the pre-cooler and the blower;

a secondary air flow path having an input end for receiving air and an output end for expelling air, the secondary air flow path having a fan adjacent to the output end, the secondary air flow path also having components of an air conditioner assembly including a compressor between the air input and the fan and a condenser between the compressor and the fan and also including a first line connecting the compressor and the condenser and a second line connecting the condenser and the evaporator and a third line connecting the evaporator and the compressor, the lines functioning to convey a working fluid between the components of the air conditioner assembly; and an open loop direct evaporative cooling tower having a coolant fluid with a coolant fluid input and a coolant fluid output with a heat exchanger section for conveying coolant fluid there between, the tower having a reservoir below with a pump to cause a cooling flow of water from below the section to a location above the section for flowing over the section to evaporate and cool the coolant fluid, the tower also having a fan there above to further evaporate and cool the coolant fluid, the fluid output having two pumps to feed the coolant fluid in first and second coolant fluid paths, a first coolant fluid path being in heat exchanging relationship with the air conditioner assembly, the first coolant fluid path being attached to the first line as a first heat exchanger and attached to the second line as a second heat exchanger, the first coolant fluid path then extending back to the coolant fluid input, the second coolant fluid path coupled from the coolant fluid output to the pre-cooler and then back to the coolant fluid input.

* * * * *